US010499696B2

(12) United States Patent
Mitchell

(10) Patent No.: US 10,499,696 B2
(45) Date of Patent: Dec. 10, 2019

(54) SUPPORT ARTICLE

(71) Applicant: Marilyn Mitchell, Denver, CO (US)

(72) Inventor: Marilyn Mitchell, Denver, CO (US)

( * ) Notice: Subject to any disclaimer, the term of this patent is extended or adjusted under 35 U.S.C. 154(b) by 265 days.

(21) Appl. No.: 13/829,940

(22) Filed: Mar. 14, 2013

(65) Prior Publication Data

US 2014/0259334 A1 Sep. 18, 2014

(51) Int. Cl.
*A41D 23/00* (2006.01)

(52) U.S. Cl.
CPC ..... *A41D 23/00* (2013.01); *A41D 2023/004* (2013.01)

(58) Field of Classification Search
CPC ..... A41D 23/00; A41D 2023/002; A41D 2400/32; A41D 2400/10; A41D 13/00; A41D 13/005; A41D 13/0155; A41D 13/0531; A41D 2400/48; A41D 3/08; A41D 2023/004; A41D 27/20
USPC ..... 2/461, 207, 203, 208, 468, 91, 92, 247; 602/4, 20, 62; D2/500, 501, 502
See application file for complete search history.

(56) References Cited

U.S. PATENT DOCUMENTS 9,828 A * 7/1853 Day ..... A61F 5/3738 602/4
739,166 A * 9/1903 Funk ..... A41D 1/04 2/102
891,166 A * 6/1908 Harrison ..... A41D 23/00 2/91

(Continued)

FOREIGN PATENT DOCUMENTS

WO WO 2005/027693 A1 3/2005
WO WO 2008021443 A3 * 12/2008
WO WO 2009/009696 A1 1/2009

OTHER PUBLICATIONS

Sven-Åke Bood, "Bending and Mending the Neurosignature—Frameworks of influence by flotation-REST (Restricted Environmental Stimulation Technique) upon well-being in patients with stress related ailments" Karlstad University Studies, Jan. 2007, pp. 1-87, Universitetstryckeriet, Karlstad, Sweden.

(Continued)

*Primary Examiner* — Jameson D Collier
*Assistant Examiner* — Heather N Mangine
(74) *Attorney, Agent, or Firm* — Peter B. Scull; HDC IP Law LLP

(57) ABSTRACT

A support article, method or system for comfort and/or to promote relaxation and physical support for a wearer. A support article with an elongated member with a central section and depending sides adjustable sleeves. A method including: draping an elongated support device about one or more of the neck, a shoulder, the shoulders, and/or the back of a wearer; and, inserting one or more of the wearer's hand, wrist, forearm or arm through a corresponding sleeve to provide comfortable support. The support article serves to isometrically stabilize or structurally support one or more of the head, neck muscles, and vertebrae, to quickly achieve and maintain relaxation. The support article can relieve neck, shoulder, arm, hand, and back tension by counterbalancing a wearer's cervical spine with the weight of his or her arms. The support article provides warmth and enfolding comfort, facilitating relaxation.

3 Claims, 14 Drawing Sheets

(56) References Cited

U.S. PATENT DOCUMENTS 1,157,341 A * 10/1915 Tallerday ..... A41D 23/00 2/59
1,621,323 A * 3/1927 Horn ..... A61F 5/3746 2/92
1,797,226 A * 3/1931 Chumbley ..... A41D 23/00 2/91
2,042,442 A * 5/1936 Buchman ..... A41D 23/00 2/91
D126,586 S * 4/1941 Kasarda ..... D2/501
D127,016 S * 5/1941 Boyd ..... D2/500
D142,469 S * 10/1945 Brodigan ..... 2/91
2,413,318 A * 12/1946 Golfieri ..... A41D 25/00 2/207
2,560,243 A * 7/1951 Peterson ..... A61F 5/3746 602/4
2,616,419 A * 11/1952 Karfiol ..... A61F 5/3738 602/4
2,870,448 A * 1/1959 Rosenthal ..... A41D 1/04 2/91
3,036,450 A * 5/1962 Holder ..... A42B 1/045 2/206
3,096,759 A * 7/1963 Coolbaugh ..... A61F 17/00 2/84
3,221,958 A * 12/1965 Straight ..... A45F 5/00 2/1
3,307,538 A * 3/1967 Groll ..... A61F 5/3738 128/DIG. 15
3,559,640 A * 2/1971 Beckett ..... A61F 5/3746 602/4
3,923,050 A * 12/1975 Zeide ..... A61F 5/3761 602/4
4,109,321 A * 8/1978 Shapiro ..... A41D 23/00 2/91
4,172,292 A * 10/1979 Horton ..... A41D 11/00 2/102
4,302,849 A * 12/1981 Margetson ..... A41D 13/0015 2/115
4,337,938 A * 7/1982 Rodriguez ..... A63B 69/0059 224/258
4,483,469 A * 11/1984 Arisland ..... A45F 4/12 224/582
4,526,164 A * 7/1985 Bihl ..... A61F 5/3738 602/4
4,751,923 A * 6/1988 Marino ..... A61F 5/3738 128/878
4,878,490 A * 11/1989 Scott ..... A61F 5/3746 602/20
4,882,786 A * 11/1989 Gross ..... A41D 13/0012 2/102
D315,640 S * 3/1991 Pelzel ..... D2/500
5,072,598 A * 12/1991 Dibrell ..... A41D 13/0055 2/91
5,086,762 A * 2/1992 Chee ..... A47B 21/0371 128/873
5,141,488 A * 8/1992 Schrader ..... A61F 5/3738 128/878
5,206,957 A * 5/1993 Gulick ..... A41D 13/00 2/102
5,265,669 A * 11/1993 Schneider ..... A61F 7/02 165/46
5,358,470 A * 10/1994 Johnson ..... A61F 5/3746 128/DIG. 15
5,411,471 A 5/1995 Terrazas
5,562,604 A * 10/1996 Yablon ..... A61F 7/02 601/148
5,651,143 A * 7/1997 Zehrung ..... A47D 13/025 2/16
5,653,244 A * 8/1997 Shaw ..... A61F 5/0104 128/882
5,937,442 A 8/1999 Yamaguchi et al.
6,135,560 A 10/2000 Fagg
6,135,973 A 10/2000 Zapletal
6,190,340 B1 * 2/2001 Borell ..... A61F 5/3738 2/44
6,196,229 B1 * 3/2001 Piazza ..... A61G 7/1023 128/869
D449,422 S * 10/2001 Massie ..... D2/614
6,361,478 B1 * 3/2002 Giancaspro ..... A47D 13/086 128/875
6,371,346 B1 * 4/2002 Sharma ..... A45F 3/14 224/195
6,406,449 B1 * 6/2002 Moore ..... A41D 13/1245 602/4
6,435,185 B1 * 8/2002 Schimpl ..... A47G 9/066 128/845
6,457,195 B1 10/2002 Holste
6,595,936 B1 * 7/2003 Oladipo ..... A61F 5/3746 602/20
6,817,032 B2 * 11/2004 Hollander ..... A41B 9/06 2/69
6,859,965 B1 3/2005 Gourd
6,966,069 B2 * 11/2005 Booth ..... A47G 9/066 2/48
6,973,691 B1 12/2005 Cordova et al.
7,197,781 B2 4/2007 Ramsbottom et al.
D549,832 S * 8/2007 Estep ..... D2/829
7,306,573 B2 12/2007 Bonutti
D571,475 S * 6/2008 Estep ..... D2/829
D583,535 S * 12/2008 George ..... D2/864
7,467,423 B1 * 12/2008 Tawfik ..... A41D 23/00 2/207
7,779,486 B2 * 8/2010 Tomlinson ..... A41D 3/00 2/108
7,841,997 B1 * 11/2010 Heller ..... A61F 5/3738 128/878
7,927,311 B1 * 4/2011 Bachelder ..... A45F 5/00 224/148.4
8,141,187 B2 3/2012 Schwingendorf et al.
8,196,588 B1 * 6/2012 Krenzel ..... A61F 5/3738 128/869
8,197,429 B2 * 6/2012 Neseem ..... A61F 5/00 602/4
8,468,612 B1 * 6/2013 Galloway ..... A41D 23/00 2/207
8,485,596 B1 * 7/2013 Martin ..... A47G 9/066 2/84
D695,490 S * 12/2013 Lake ..... D2/502
8,726,421 B2 * 5/2014 Alvarez ..... A41D 13/0512 2/207
8,793,815 B1 * 8/2014 Kelley-Mozsy ..... A41D 27/20 2/247
8,910,315 B1 * 12/2014 Stephens ..... A41D 1/04 2/102
8,944,682 B2 * 2/2015 Lee ..... A45F 4/00 2/91
9,089,198 B1 * 7/2015 Devereaux ..... A45F 5/022
9,474,311 B2 * 10/2016 Short ..... A41D 27/20
2002/0156406 A1 * 10/2002 Moore ..... A61F 5/3746 602/4
2002/0156407 A1 * 10/2002 Estep ..... A61F 5/3746 602/4
2004/0250332 A1 * 12/2004 Tadin ..... A41D 13/0007 2/94
2005/0039242 A1 * 2/2005 Edmondson ..... A41D 23/00 2/207
2005/0055775 A1 3/2005 Gourd
2006/0010569 A1 * 1/2006 Tawfik ..... A41D 23/00 2/207
2006/0047229 A1 3/2006 Dussaussoy
2006/0117455 A1 * 6/2006 Park ..... A41D 3/08 2/69.5
2007/0033706 A1 * 2/2007 Kuhlmann ..... A41D 23/00 2/207
2008/0045870 A1 * 2/2008 Nozik ..... A61F 13/66 602/4
2008/0301863 A1 * 12/2008 Goff ..... A41D 13/0012 2/467
2009/0013471 A1 1/2009 Yang

(56) References Cited

U.S. PATENT DOCUMENTS

2009/0062702 A1* 3/2009 Sojka ..... A41D 13/0531 602/2
2010/0146680 A1* 6/2010 Cuoco ..... A41D 3/08 2/84
2010/0237121 A1* 9/2010 Stein ..... A41D 15/04 224/577
2011/0004971 A1* 1/2011 Benderradji ..... A41D 23/00 2/84
2011/0213282 A1* 9/2011 Cortese ..... A61F 5/3746 602/4
2012/0042432 A1* 2/2012 Tawfik ..... A41D 23/00 2/66
2012/0066812 A1* 3/2012 Alzate ..... A41D 23/00 2/159
2012/0079644 A1* 4/2012 Benderradji ..... A41D 15/007 2/207
2012/0144557 A1* 6/2012 Walker ..... A41D 23/00 2/207
2012/0204323 A1* 8/2012 Park ..... A41D 23/00 2/202
2012/0291179 A1* 11/2012 Shea ..... A41D 27/20 2/102
2013/0061370 A1* 3/2013 Ezell ..... A41D 23/00 2/207
2013/0227761 A1* 9/2013 Hoskins ..... A41D 23/00 2/207
2013/0233843 A1* 9/2013 Hoberty ..... A41D 23/00 219/211
2014/0259334 A1* 9/2014 Mitchell ..... A41D 23/00 2/461
2015/0080776 A1* 3/2015 Davis ..... A61F 5/3738 602/4
2015/0297860 A1* 10/2015 Kealey ..... A61F 7/02 600/27
2015/0313301 A1* 11/2015 Shineman ..... A41F 15/00 2/208
2016/0255887 A1* 9/2016 Scarione ..... A41D 23/00
2016/0270464 A1* 9/2016 Nigri ..... A41D 27/20
2017/0036573 A1* 2/2017 Webb ..... B64D 11/0646
2017/0208881 A1* 7/2017 Leathers ..... A41D 23/00
2017/0332795 A1* 11/2017 Lunsford ..... A61F 5/0118

OTHER PUBLICATIONS

Kerstin Uvnäs-Moberg et al, "Oxytocin, a Mediator of Anti-stress, Well-being, Social Interaction, Growth and Healing" Zeitschrift fur Psychosomatische Medizin and Psychotherapie , Feb. 2005; pp. 1-25; Göttingen : Vandenhoeck & Ruprecht, Germany.

* cited by examiner

SUPPORT ARTICLE

BACKGROUND

The instant disclosure relates to a support article adapted to facilitate relaxation of the muscles and/or provide structural support of one or more of a user's head, neck, shoulders, arms, hands back, or other body feature.

Many desires exist to promote relaxation and physical upper body support for one or more of a user's, head, neck, shoulder, arm, hand, and/or back. Indeed, benefits may be immediately recognized from a therapeutic device for relief of neck, shoulder, arm, hand and/or back tension. Provision may thus be sought for one or more of (1) effective stabilization support for head, neck, shoulders, arms, hands, and/or backs of individuals needing to sleep in a seated position (e.g., travelers), (2) head, neck, shoulder, arm, hand and/or back support for individuals engaged in activities such as reading or operating a handheld device such as an electronic tablet, (3) a neck collar or sling for use by patients during recovery from neck trauma, or shoulder and/or arm injuries and/or surgeries, (4) warmth and steady-but-gently-restrictive support for individuals with abnormally high upper body tone (e.g., hypertonia/spasticity), and/or (5) soothing benefits for any or all wearers from enfolding warmth, inter alia of a support article.

One or more of the above desiderata may be achieved by or through use of the developments of the present disclosure.

BRIEF SUMMARY

A support article may include an elongated member with a central section and two depending sides with at least one sleeve defined therein. A method may include draping an elongated support device about one or more of the neck, a shoulder, the shoulders, and/or the back of a wearer; and, inserting one or more of the wearer's hand, wrist, forearm or arm through a corresponding armrest sleeve to provide comfortable support thereto.

The foregoing and/or other aspects, features, details, utilities, and advantages of the present disclosure will be apparent from reading the following description and claims, and from reviewing the accompanying drawings.

DETAILED DESCRIPTION

Figure 1:
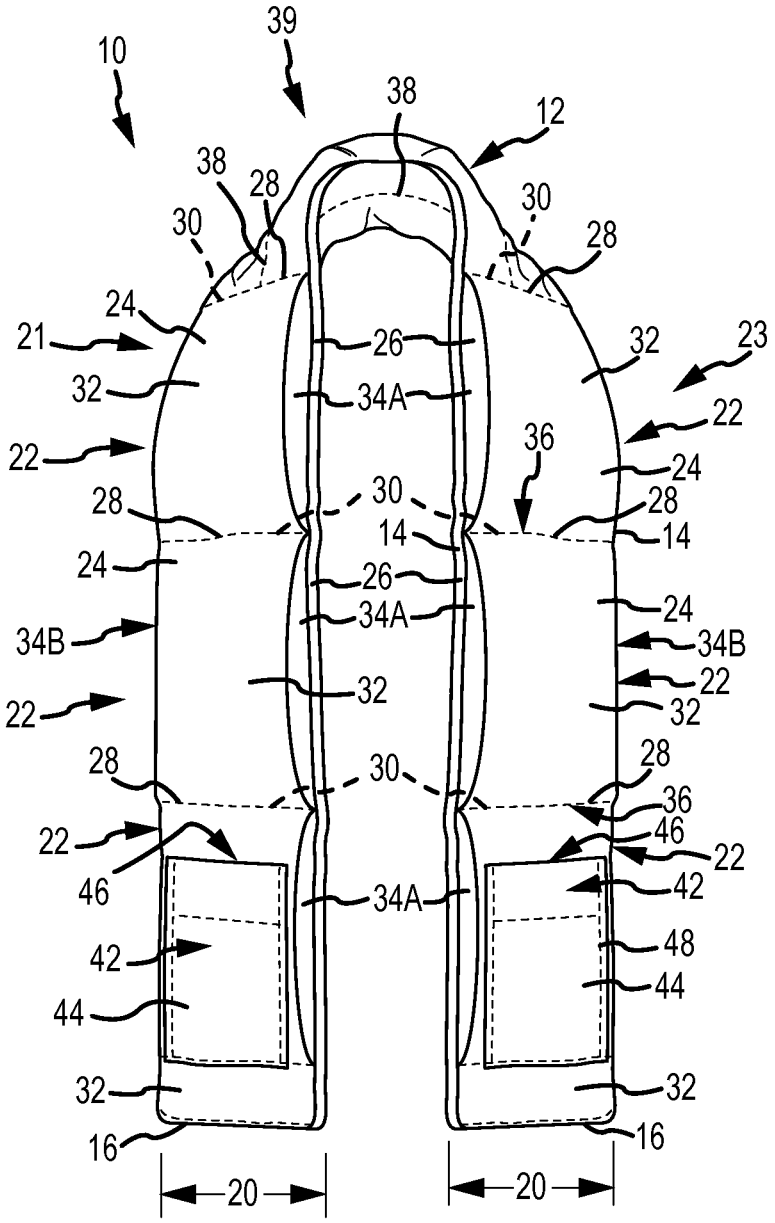
FIG. 1 is an isometric view of an implementation of a support article hereof.

Muscles in the neck, shoulders, arms, and back, such as the scalenes, sternocleido mastoids, splenus capitus, rectus capitis, suboccipitals, erector spinae complex, transverso spinalis group, intercostales, serratus, pectoralis, trapezius, levator scapulae, rotator cuff supraspinatus, infraspinatus, teres minor, and subscapularis, teres major, biceps, triceps, deltoids, brachialis, brachioradialis rhomboids, latissimus dorsi, inter alia, accumulate tension and add to an individual's stress level. Relaxing these muscles is believed to provide stimulation of the parasympathetic nervous system (PNS). The PNS slows the heart rate, reduces blood pressure, and facilitates relaxation as a counterbalance to fight or flight responses (stress) and cortisol (a stress hormone) triggered by the sympathetic nervous system.

Research has been performed on the effects of floatation sensory deprivation in which the buoyancy of saltwater in float tanks provides the body with a break from the normal strain of holding the body erect in opposition to gravity. Such respite from gravity's pull has been found to result in deep relaxation. Likewise, the support article allows muscles to relax, thereby providing respite from the tension a body experiences when in an upright position as it persistently resists gravity. See Sven-Ake Bood, "Bending and Mending the Neurosignature," DISSERTATION; Karlstad University Studies; 2007:25; pp. 10-11.

Relaxation can provide indirect activation of the parasympathetic nervous system. Relaxed muscles send messages to alarm centers in the brain that nothing is alerting the body to a threat. Relaxed muscles may directly release oxytocin, the "bonding hormone" that regulates sociability, stress, feelings of trust, connection and generosity. Oxytocin calms, stimulates social interaction and produces an anti-stress pattern. See, e.g., Uvnas Moberg, 2002; DISSERTATION; Karlstad University Studies; 2007:25. Through mechanisms indirectly associated with oxytocin, the activity of the HPA axis (the hypothalamic-pituitary-adrenal axis) is reduced. The activity is slowed down because the oxytocin counteracts the effect of vasopressin and the corticotrophin hormone (CRH) of the pituitary and the brain stem. The release of CRH and the adrenocorticotropic hormone (ACTH) is slowed down. At the same time, the release of cortisol into the bloodstream is reduced, blood pressure drops, and the anti-stress system is activated.

The nonapeptide oxytocin, originally known to stimulate labor and milk ejection, appears to play an important role in stress and pain. It can induce anti-stress-like effects such as reduction of blood pressure and cortisol levels. It increases pain thresholds, exerts an anxiolytic-like effect and stimulates various types of positive social interaction. In addition, it promotes growth and healing. Repeated exposure to oxytocin causes long-lasting effects by influencing the activity of other transmitter systems, a pattern that makes oxytocin potentially clinically relevant. See, e.g., Uvnas Moberg, supra.

FIGS. 1 through 14 show example implementations of a support article 10 that can be used to promote relaxation and physical support for a user. Such a support article 10 may be used to relieve head, neck, shoulder, arm, hand, and back tension and/or to relieve a user's cervical spine and/or support the weight of a user's arms. Such a support article 10 can be used to isometrically stabilize neck muscles and vertebrae to enhance the user's ability to quickly achieve and maintain relaxation. A support article 10, for example, may be used to provide one or more of (1) effective stabilization support for head, neck, and arms of individuals needing to sleep in a seated position, (2) arm and hand support for individuals engaged in activities such as reading or operating a handheld device, e.g., an electronic tablet, (3) a neck collar or sling for use by patients under doctor or therapist supervision during recovery from neck, shoulder or arm injuries or surgeries, (4) warmth and steady-but-gently-restrictive support for individuals with abnormally high upper body tone (e.g., hypertonia/spasticity), and/or (5) soothing benefits from being supported by the support article's soft, enfolding warmth. Such a support article 10 may be used by various people, such as travelers, meditators, yoga practitioners, athletes, nursing mothers, readers, the elderly, computer operators, television viewers, or patients (e.g., those engaged in physical or psychological therapy), inter alia.

In the implementation shown in FIGS. 1 through 12, a support article 10 may, as best shown in FIGS. 1 and 2, be an elongated structure 12 with one or more pockets or sleeves 22 (see also 32 in FIGS. 1, 2) defined therein. In some implementations such as shown in FIGS. 1 and 2, article 10 may include a generally rectangular or elongated structure 12 having a pair of longitudinal edges 14 extending along a longitudinal length 18 and a pair of relatively-shorter lateral, end edges 16 extending along a lateral width 19 (note, the word rectangular as a descriptor here does not require absolute right angled or squared corners or slavish attention to parallel sides; many elongated figures with rounded corners or the like can be reasonably understood as within the understanding of the developments hereof without departing from the spirit hereof).

FIG. 1 shows an isometric view of such a support article 10 in a configuration as a support article 10 that may be draped over the shoulders and neck of a person (person not shown in FIG. 1, but, see e.g., FIGS. 4-12). When implemented in a fashion similar to that shown in FIG. 1, the elongated structure 12 of the support article 10 may thus have a substantially central section 39 that may in some implementations be cushioned, and may be typically disposed adjacent the user's neck, a shoulder or both shoulders. The elongated structure 12 may thus also have first and second side sections 20 and 21 or depending sections 20, 21; here, first side section 20 shown in the left side of the drawing and second side section 21 on the right (though for the user the relative disposition will be the opposite, i.e., for the user the first side portion will be his/her right side portion, and the second side will be the left side relative to the user).

Along the longitudinal length 18 of the support article 10, material such as that used in the formation of the support article 10 may be adjustable and in many implementations article 10 may define a plurality of armrest sleeve accesses 22 for receiving one or both hands and forearms of a wearer (details of use set forth below). These sleeve accesses, may, by means of their particular, layered construction, serve to equip the generally rectangular or elongated support article with a plurality of armrest-sleeve accesses. Each of these various accesses may thus define armrest sleeves, adapted to receive the hands, wrists and/or forearms of a wearer as these anatomical extremities extend into the armrest sleeves that span the relatively short, lateral width of the support article. The armrest sleeves, being arranged adjacent to each other along the longitudinal length of the generally rectangular or elongated support article, may provide among other functions, adjustability in the support article's length, depending on which pair of armrest sleeves the wearer selects.

In the particular implementation shown in FIGS. 1 through 12, such support articles 10 include six armrest-sleeve accesses 22; sometimes also referred to herein as accesses 22A/22B (see 34A/34B in FIGS. 1, 2, e.g.); three on each side; i.e., three accesses on first side 20 and three accesses on second side 21, although a support article 10 within the scope of the present disclosure may include any practical number of accesses. For example, a support article could be made nine feet long with twelve (instead of six) armrest-sleeve accesses meant variously to accommodate a user's hands, forearms and/or feet and/or forelegs as a supportive implement for use in the practice of yoga or meditation or for one or more usages such as those described here or derivable herefrom or similar hereto. Another support article could be made having only four, small, armrest-sleeve accesses such that a baby or child wearing it would be supported while sleeping in a car seat, or watching TV, or for one or more usages such as those described here or derivable herefrom or similar hereto. Use of a single sleeve may occur for example, where the central section is draped over a single shoulder so that only one of the depending sides is in the front of the user, the other depending side in the back; in this sort of implementation, a sleeve might be used, for example, to accept a lower portion of the opposing depending side therewithin to perhaps hold the elongated structure so that a single front side sleeve may be used with a hand, wrist or forearm disposed therein.

In this first implementation of FIG. 1, the armrest-sleeve accesses 34A/34B (22A/22B) are or may be defined by a longitudinal armrest sleeve panel 24 (opposing layer 26) attached to the body of the support article 10; the upper/outer layer 24 relative to the under/inner layer 26. In this configuration, the opposing layer(s) are two longitudinal armrest sleeve panels 24, applied to both end regions of the support article 10 and attached at lateral points/lines 28, as shown most clearly in FIGS. 1-2A and FIGS. 4-10 to form armrest sleeves 32. Alternatively, opposing layer(s) 24 can be relatively smaller, separate pieces of material, attached individually to opposing layer 26. Layers 24 and 26 of the support article may be, as shown, attached at least partially along a pair of opposing laterally-defined attachment points/lines 28. The opposing layers 24 and 26 may be secured along such lines 28 via any number of means of attachment, such as stitching 30 (shown in FIGS. 1 and 2), adhesive, bonding, heat staking, hook and loop fasteners, hooks, snaps or any combination or any practical and/or readily appreciable alternative thereof. If opposing layer(s) 24 is implemented as the preferable choice for forming armrest sleeves 32, attachment of opposing layer(s) 24 to opposing layer 26 may be accomplished by the foregoing variety of attachment methods. Note, layer 24 may be made of one or more layers itself either for thickness or for preferred texture, and/or for adding cushioning therewithin.

Each of the armrest-sleeve accesses 34A, 34B (22A/22B) are or may be adapted to receive the hands, wrists and/or forearms of a wearer as shown in FIGS. 4-12. In many implementations, the armrest-sleeve accesses 22A/22B may include or be formed by a sleeve 32 with two lateral opposing openings 34A and 34B defined by 24 and 26 disposed along, adjacent or often, typically (though not absolutely necessarily) near the longitudinal edges 14 of the support article 10. The armrest-sleeve accesses 22 (22A/22B) disposed along, adjacent or near the longitudinal edges 14 of the support article 10, lateral openings 34A and 34B may be bounded by attachment points/lines 28 that form ends 36 of the armrest sleeves 32. A wearer may extend hands and forearms laterally through the armrest sleeve openings 34A or 34B or armrest-sleeve accesses 22 (22A/22B) from either direction.

Figure 2A:
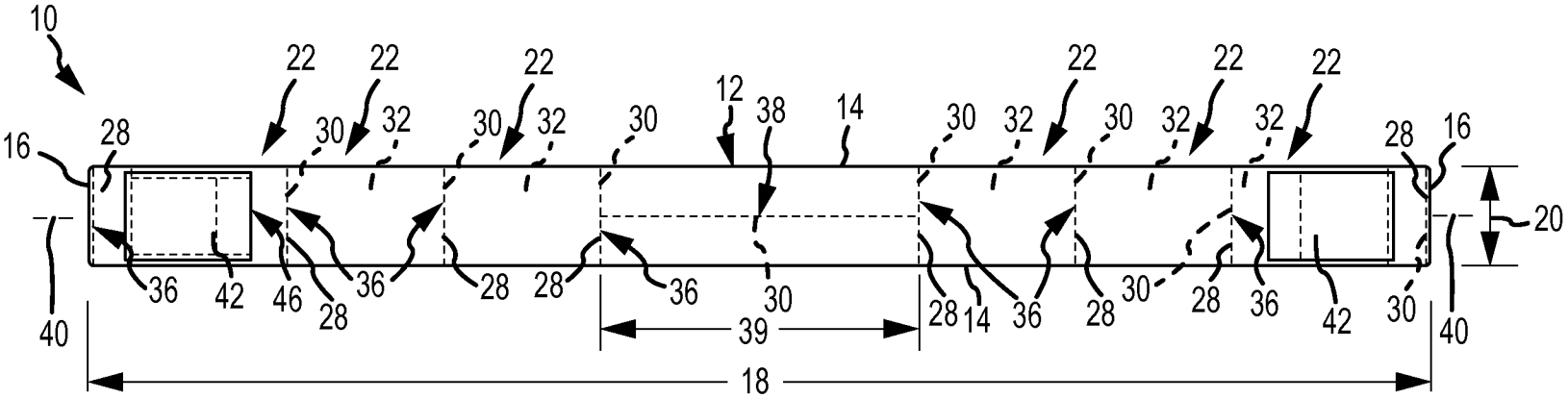
FIG. 2, which includes sub-part FIGS. 2A and 2B, includes plan views of a first side and a second opposing side, respectively, of a support article such as that shown in FIG. 1.
Figure 12:
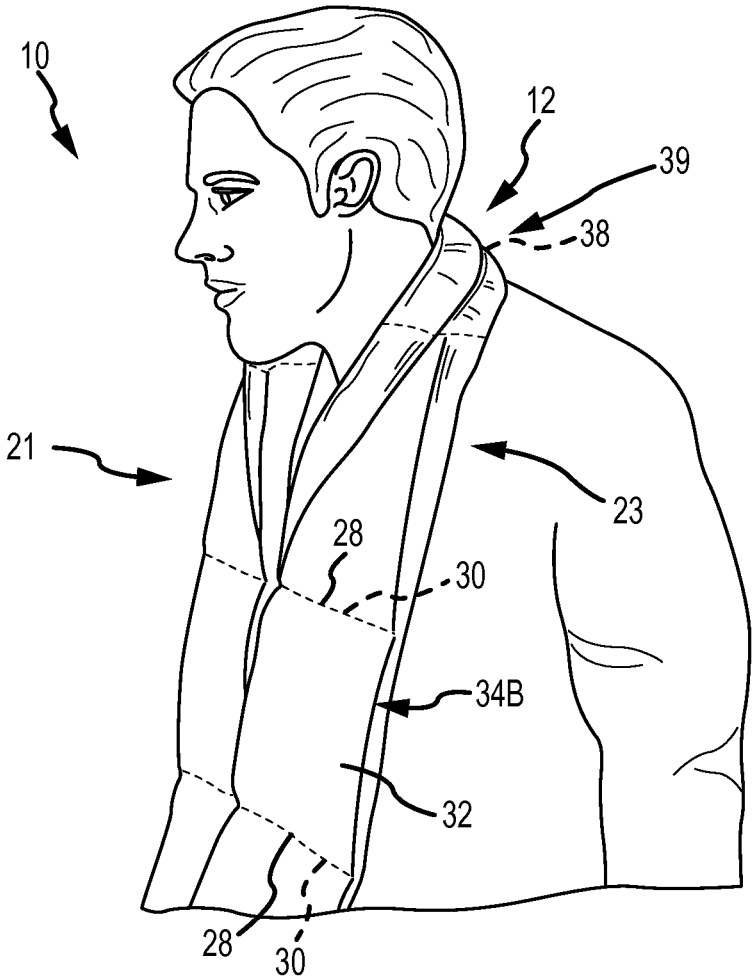
FIG. 12 is an isometric view of a support article such as those shown in FIGS. 1 through 3 being used by a wearer in a ninth example configuration.

FIGS. 1 and 2A further show a support article 10 having a fold/roll/anchor/stitch line 38 (better shown in FIGS. 8 and 12, detailed more in and/or with more respect to FIG. 12) extending longitudinally along the support article 10 along a relatively central section 39 of the support article 10. The fold/roll/anchor/stitch line, 38 and the support article's central section 39, are position-adapted to be draped over or around the neck and/or shoulder region of a wearer. In the particular implementation shown in FIGS. 1, 2, 8, and 12, for example, the fold/roll/anchor/stitch line 38 exists only in the central neck section of support article 39, between two lines of lateral stitching 30 along a generally medial axis 40 (see FIGS. 2A and 2B) of the support article 10 to enable a wearer to fold this section of the support article to reduce the relatively central section of the lateral width 19 of the support article 10 by approximately one-half. In use, this alternative is shown in FIG. 12 where, when folded about or near a fold/roll/anchor/stitch line such as line 38, a relative lapel-like presentation may be seen (see FIG. 12); which might provide a thinner contact area at or around the user's neck if and/or as such may be desired. Similarly, the fold/roll/anchor/stitch line 38 is not necessarily limited to central axis disposition, but rather, may be disposed displaced from the medial axis 40 and/or additional roll lines may be provided to allow the lateral length to be reduced at a particular location of a support article 10, such as a location of the support article 10 adapted to drape over the neck and/or shoulder region of the wearer, to provide additional adjustability to the lateral width of the support article 10 in that location. The fold/roll/anchor/stitch line 38, for example, may be formed by a stitching line 30 (see FIG. 2A) or other line (e.g., adhesive, bonding, heat staking, hook and loop fasteners, hooks, snaps, magnets, or any combination thereof) that may be used to assist a wearer in the folding, bending, or securing of such a support article 10 along that line.

A support article 10 hereof may further have or include one or more, or a pair of pockets, such as pockets 42 from the drawings (though fully functional alternative implementations will be available without any pockets; fully functional for comfort and support as described). Such pockets 42 may be formed by an additional layer 44 of material or the like appropriate device attached to an outer opposing layer 23 or 24 of a support article. In many implementations, the additional layer 44 is rectangular or elongated and attached along three of its four edges, as by stitching or the like, to a portion of the layer 23 or 24 which form armrest sleeves 32; the fourth edge of layer 44 remains unattached to the outer opposing layer 23 or 24, of the layer 44 and defines a pocket opening 46. In the example implementation shown in FIG. 1, each of two pockets 42 are shown formed by a generally rectangular or elongated layer 44 that is attached to the outer opposing layer 23 or 24 of an underlying armrest sleeve 32 along three sides of the generally rectangular or elongated layer 44 and not attached along the fourth side of the generally rectangular or elongated layer 44 forming the opening 46 of the pocket 42. The layer 44 may be attached in any practical manner such as by stitching 30 or other attachment mechanism.

A support article 10 can be made of any number of materials, typically of soft or comfortable clothing type materials, often including materials such as fleece, cotton, wool, bamboo, silk, polyester, or blends of various fibers such as cotton/polyester, or hemp/Lyocell, inter alia. In some instances, a single or mere double layer of material may be used without any filling material; however, often, a fleece filling (e.g., POLARTEC™) or batting or other filling may be disposed throughout, or at various strategic locations as for example at/within the central or neck section (though could also be in the depending sides and/or in the panels forming the sleeves as well) within the support article 10 to provide insulation and/or cushioning at one or more locations of the support article 10. For example, in some implementations, one or two inches (or like thicknesses not limited hereto) of fleece or batting (e.g., 1.5 inches of batting; inter alia) may be provided in various locations (e.g., in the neck area generally in the central region 39, inter alia, of the support article) to provide cushioning, padding, support and/or insulation to the support article. In addition, stitching or other attachments may be disposed at or adjacent the locations of the batting to anchor the batting at those locations and prevent the fleece filling or batting from shifting within the support article 10. For example, batting may be provided throughout the central region 39, length and width thereof, and sewn in place by stitching along central fold/roll/anchor/stitch line 38 to hold the fleece filling or batting in place in the central region. In the implementation shown in FIG. 1, for further examples, fleece filling or batting or other filling material may be disposed within the support article within the body portion 12 at or adjacent the armrest sleeves 32, along the fold/roll/anchor/stitch line 38, and/or in any other locations within the support article 10. In a primary example, fleece filling or batting may be included within either the central section alone, or within the entire structure 12, along the entire length 18 and along the entire width 19.

Figure 2B:
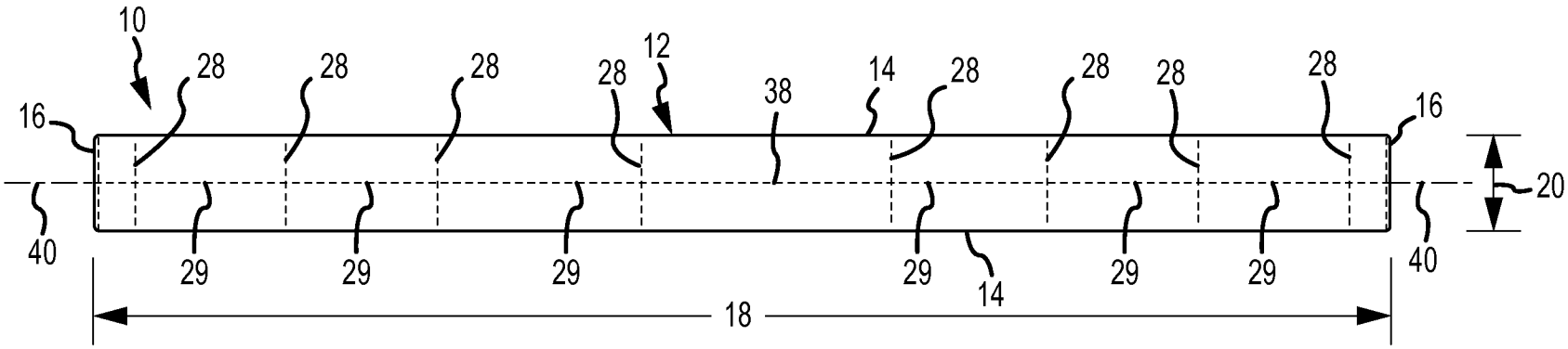

FIGS. 2A and 2B show a plan view of a first side and a second opposing side, respectively, of a support article such as that shown in FIG. 1. As shown in FIG. 2A, the first side, typically a top or outer side (though not necessarily), of the support article 10 shows a plurality of armrest sleeve accesses 34A/34B (22A/22B) defined by armrest sleeves 32 and lateral attachment points/lines 28. This example of a support article 10 further includes roll line 38 and pockets 42. The various lines 28 and fold/roll/anchor/stitch line 38 as well as attachment lines securing the pockets 42 may additionally provide anchors for batting or other filling to secure the batting or other filling within various locations of the support article 10.

FIG. 2B is a plan view of a second opposing side of the support article 10 shown in FIGS. 1 and 2. As shown in FIG. 2B, the second side, typically an under or inner side (though not necessarily), of the support article 10 shows the opposing sides of the plurality of armrest-sleeve accesses 34A/34B (22A/22B) defined by lateral attachment points/lines 28. FIG. 2B further shows the roll line 38 as well as seam 29 that extends the entire length 18 of the support article 10. Seam 29 joins the two edges of the single piece of fabric that forms the body of the support article 10. Each of these attachment lines or attachment points 28, and 38 may provide anchors for fleece filling or batting or other filling to secure the fleece filling or batting or other filling within various locations of the support article 10.

Figure 3:
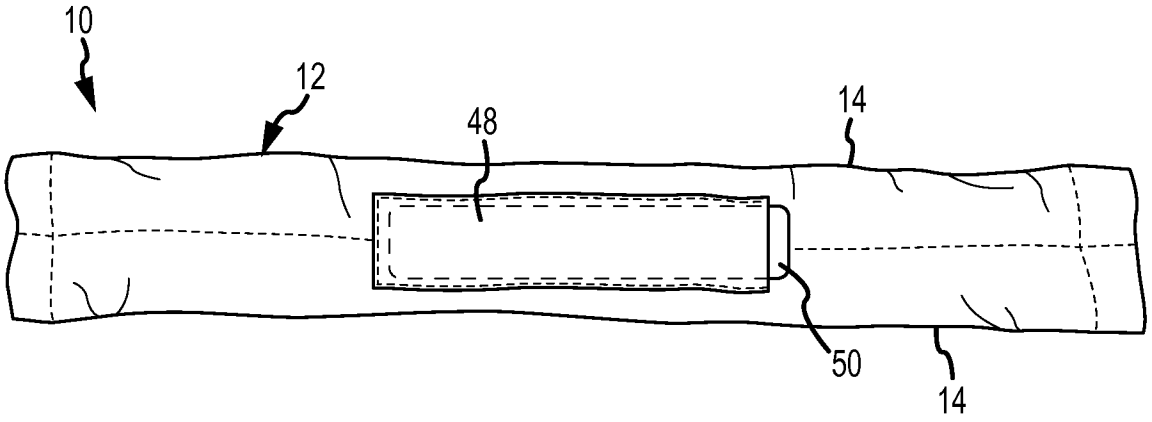
FIG. 3 is a plan view of a support article, or a part thereof, which may include some or all the features of and be not unlike those shown in FIGS. 1, 2A and 2B further showing a pocket for receiving a therapeutic device such as a hot, cold, or magnetic pack.

FIG. 3 is a plan view of a side (in one view, a portion of a side) of an implementation of a support article 10 not very unlike those shown in FIGS. 1 and 2. In this implementation shown in FIG. 3, a support article 10 includes a pocket 48 for receiving a therapy device 50 which may be a thermal device 50 such as a hot or cold pack or may be or include one or more therapeutic magnets. In this implementation, the pocket 48 may be a thermal or magnetic pocket and the thermal or magnetic device 50 may be a thermal or magnetic therapy device which may be used to provide thermal or magnetic therapy to the wearer. Although FIG. 3 shows the pocket 48 disposed on the second opposing side of the support article 10, the pocket 48 may be disposed on either side of the support article 10, either adapted to be disposed directly adjacent to the wearer or on the opposing side of the support article 10 opposite to the wearer. Thermal energy transfer between the wearer and the thermal therapy device 50 may, for example, be controlled depending on the location of the pocket. If the pocket is on a side of the support article 10 directly adjacent to the wearer, for example, more direct thermal transfer may be provided, while if the thermal therapy pocket 48 is disposed on the opposite side of the support article from the wearer (especially if fleece filling or batting or other insulating material is disposed within the support article at that location), more indirect thermal energy transfer may be provided. A magnetic therapy device will not be affected by intervening, insulating material.

Although the pocket 48 is not shown in each implementation of the support article 10 shown in the various FIGS. included herein, such a pocket 48 may be used in any of the other implementations shown in these FIGS. Also, a large number of variations in pocket disposition may be provided; particularly also as to the location of the opening for access. In FIG. 3, the opening is shown at one of the shorter sides; although such an opening may be along all, substantially all, or a mere portion of the length of the pocket 48. It may be along an edge or along a more central disposition. The opening may be closable, and may be closable by a number of optional alternatives, as for example by openable closures such as zippers, hook and loop fasteners (e.g., VELCRO™ fasteners), buttons, snaps, or other practical optional alternatives.

Figure 4:
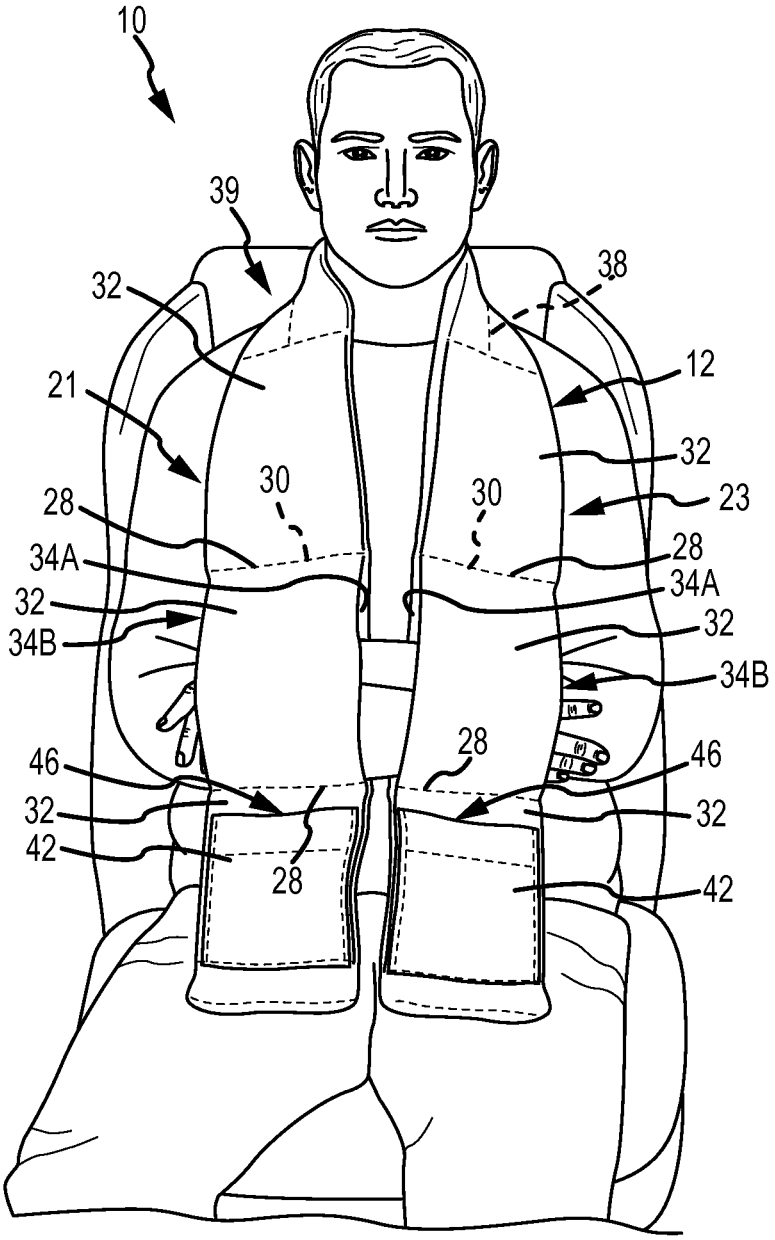
FIG. 4 is an isometric view of a support article such as those shown in FIGS. 1 through 3 being used by a wearer in a first example configuration.

FIG. 4 is an isometric view of a support article 10 such as those shown in FIGS. 1 through 3 (may though need not be identical to other implementations) being used by a wearer in a first example configuration. In this use configuration, the support article 10 is draped over the neck and shoulders of a wearer, the central portion 39 about the neck and the longitudinal ends defining the respective first and second sides 21 of the support article 10 including the six armrest-sleeve accesses 22 (22A/22B), (three accesses on side 20, three on side 21), are positioned along the longitudinal length of the support article 10 such that a wearer has multiple locations through which he or she can extend one or both arms. Although six armrest-sleeve accesses 22 (22A/22B) are shown, the support article 10 may include any practical number of armrest accesses.

In this example, the wearer has extended his hands and arms through a pair of opposing middle level accesses 22 (22A/22B) at the same general level to each other and that correspond to a comfortable position and in which the wearer is able to grasp one hand with another or pass one hand and forearm over the other. The support article 10 in this configuration, can provide stabilizing support for the head, neck, shoulders, arms, hands, and back of the wearer. The support article 10 may also provide warmth and soothing therapeutic benefits.

Figure 5:
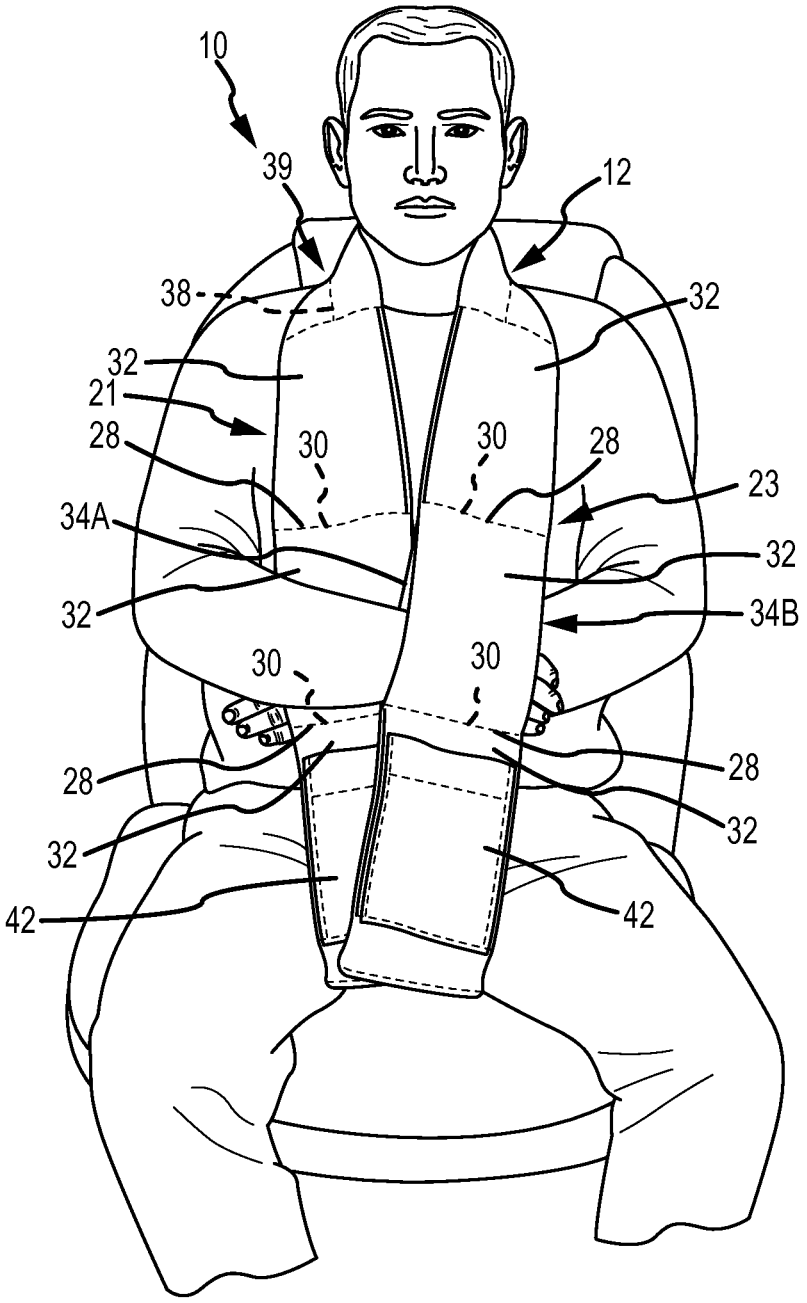
FIG. 5 is an isometric view of a support article such as those shown in FIGS. 1 through 3 being used by a wearer in a second example configuration.

FIG. 5 is an isometric view of another support article 10 such as those shown in FIGS. 1 through 3 (may though need not be identical to other implementations) being used by a wearer in a second example configuration. In this second configuration, the wrap support article 10 is again draped over the neck and shoulders of a wearer, central portion 39 about the neck, and the longitudinal ends/sides 20, 21 of the support article 10 include a total of six armrest-sleeve accesses 22 (22A/22B) (three accesses on each longitudinal end/side 20, 21) that are positioned along the longitudinal length of the support article 10 such that a wearer has multiple locations through which he or she can extend one or both hands and forearms. Although six armrest-sleeve accesses 22 (22A/22B) are shown, the support article 10 may include any number of armrest accesses. In this configuration, the wearer has extended his left hand and forearm across his midline and into an armrest sleeve 32 of the support article's right side 20. He has then passed his right hand and forearm under the support article's right side 20 and into an armrest sleeve 32 of the support article's left side 21. This configuration, with the wearer's hands/forearms positioned across his midline in separate armrest sleeves 32, may be less restrictive than the hand/forearm positioning in FIG. 4.

Figure 6:
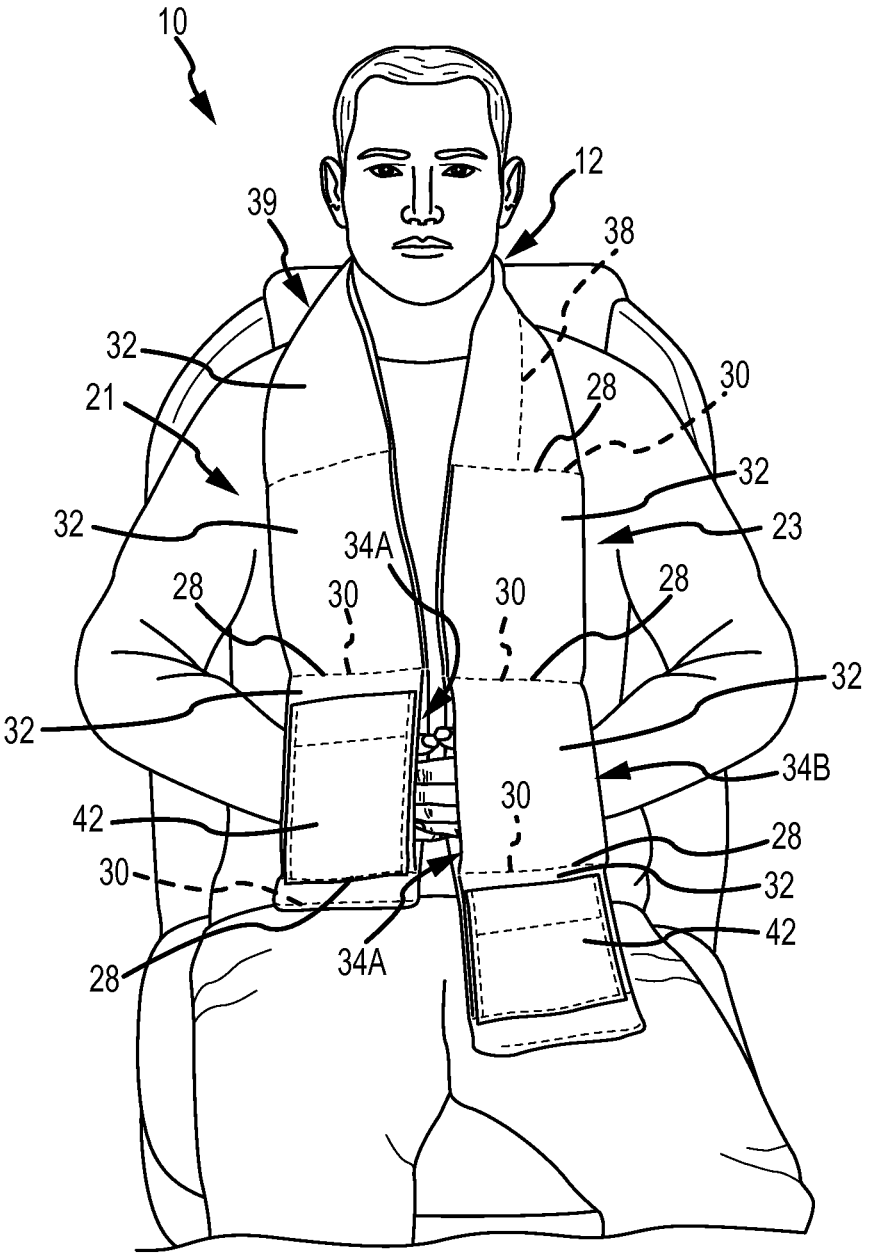
FIG. 6 is an isometric view of a support article such as those shown in FIGS. 1 through 3 being used by a wearer in a third example configuration.

FIG. 6 is an isometric view of yet another support article 10 such as those shown in FIGS. 1 through 3 (may though need not be identical to other implementations) being used by a wearer in a third example configuration. In this third configuration, the support article 10 is again draped over the neck and shoulders of a wearer in an offsetting manner such that a second longitudinal end or side 21 of the support article 10 extends lower than a first longitudinal end or side 20 of the support article 10 on the wearer, and the wearer has extended his arms through a pair of offsetting opposing accesses 22 (22A/22B) at different longitudinal locations along the support article 10 that correspond to a comfortable position in which the wearer's arms are able to extend at different angles and/or lengths from the wearer's shoulder. This alternative implementation helps demonstrate the support article's 10 alternative sizing options for users of various sizes, taller and/or shorter such that many comfortable positions may be achieved. The support article 10, in this third configuration, also provides stabilizing support for a wearer's head, neck, shoulders, arms, hands, and back.

Figure 7:
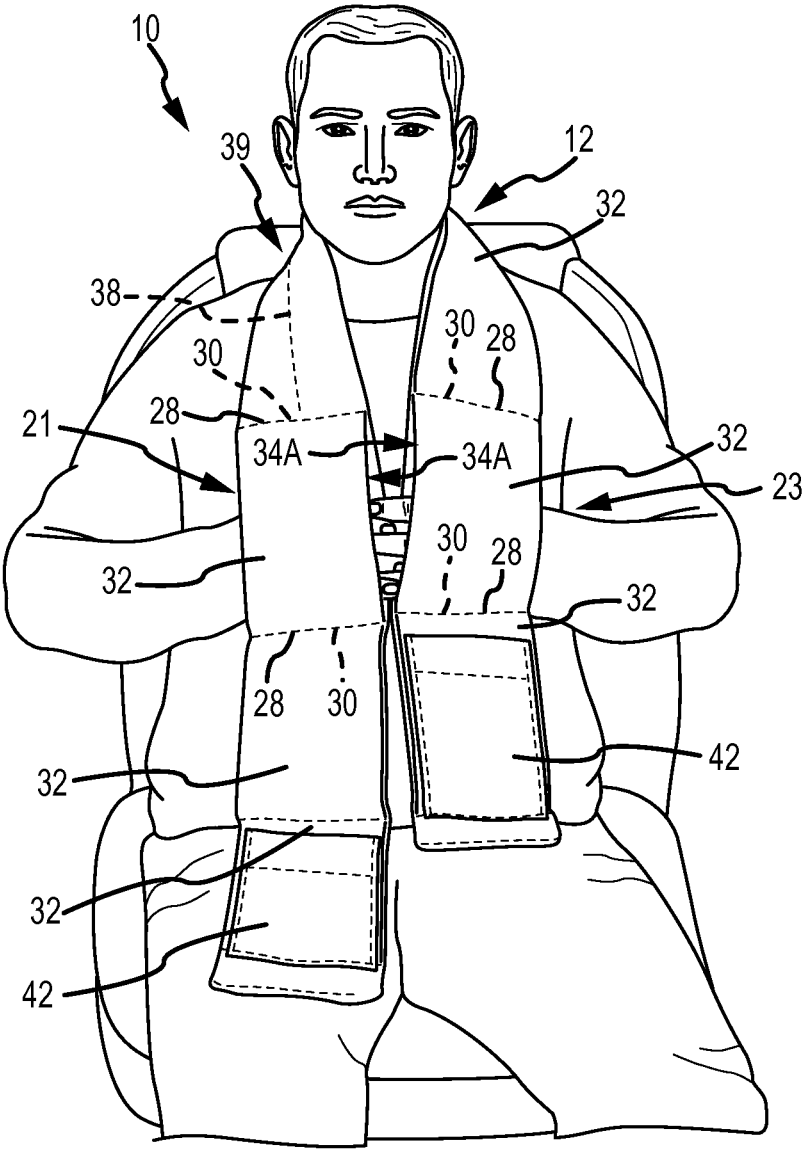
FIG. 7 is an isometric view of a support article such as those shown in FIGS. 1 through 3 being used by a wearer in a fourth example configuration.

FIG. 7 is an isometric view of still another support article 10 such as those shown in FIGS. 1 through 3 (may though need not be identical to other implementations) being used by a wearer in a fourth example configuration. In this fourth configuration, the support article 10 is again draped over the neck and shoulders of a wearer in an offsetting manner such that a first longitudinal end or side 20 of the support article 10 extends lower than a second longitudinal end or side 21 of the support article 10 on the wearer. In this fourth example configuration, the wearer has extended his arms through a pair of opposing accesses 22 (22A/22B) at the same general level that correspond to a comfortable position and in which the wearer is able to grasp one hand with another. The support article 10, in this fourth configuration, also provides stabilization support for the head, neck, shoulders, arms, hands, and back of the wearer.

Figure 8:
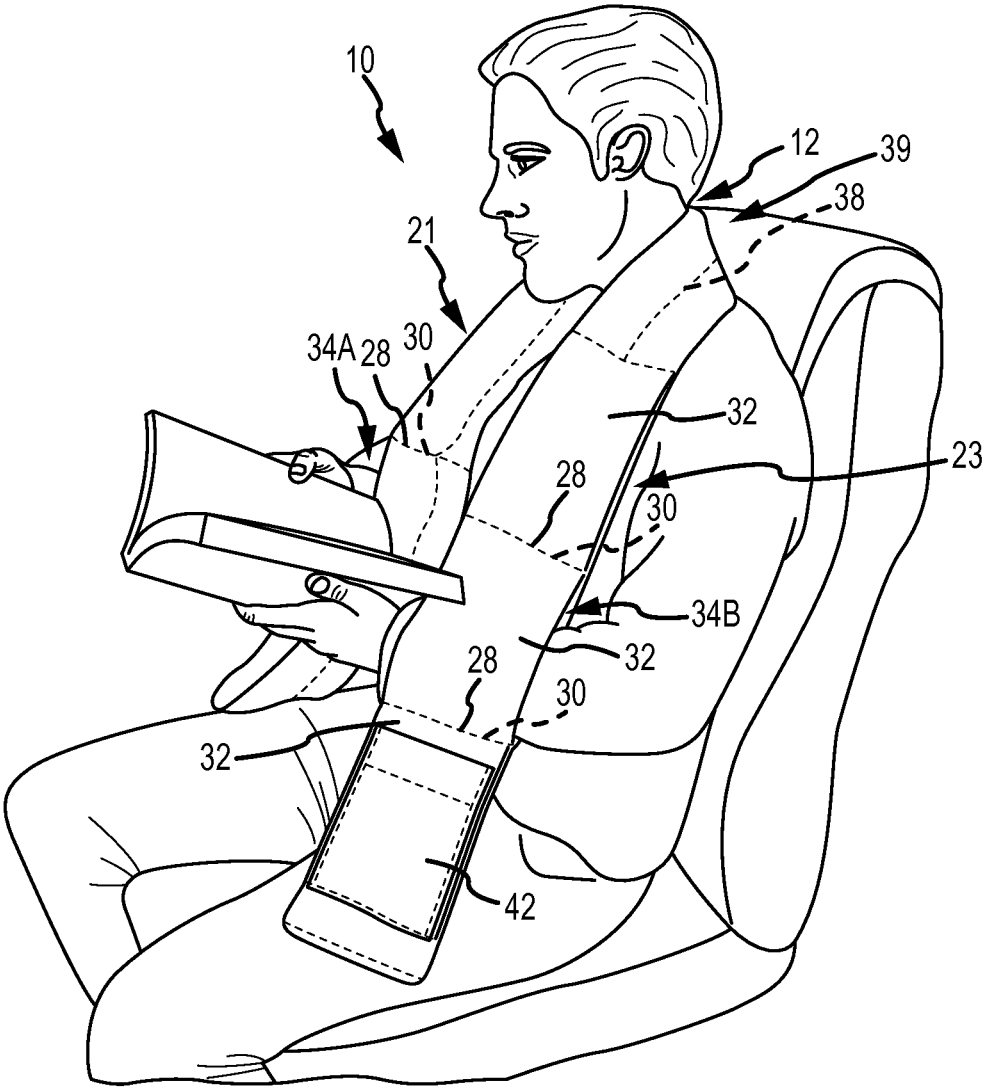
FIG. 8 is an isometric view of a support article such as those shown in FIGS. 1 through 3 being used by a wearer in a fifth example configuration.

FIG. 8 is an isometric view of yet still one further support article 10 such as those shown in FIGS. 1 through 3 (may though need not be identical to other implementations) being used by a wearer in a fifth example configuration. In this fifth configuration, the therapeutic wrap support article 10 is again draped over the neck and shoulders of a wearer and the wearer has extended his arms through a pair of opposing accesses 22 (22A/22B) at the same general level that correspond to a comfortable position and in which the wearer is able to hold a book or other item with one or both hands. In this particular configuration, for example, the wearer is grasping a book in both hands and the support article 10 is supporting the weight of the wearer's arms and hands as well as the book to provide a comfortable, supported position in which the wearer is able to read from the book or other item (e.g., a tablet, computer, video game, or the like). As in the other configurations, the support article 10, in this fifth configuration, provides stabilization support for the head, neck, shoulders, arms, hands, and back of the wearer.

Figure 9:
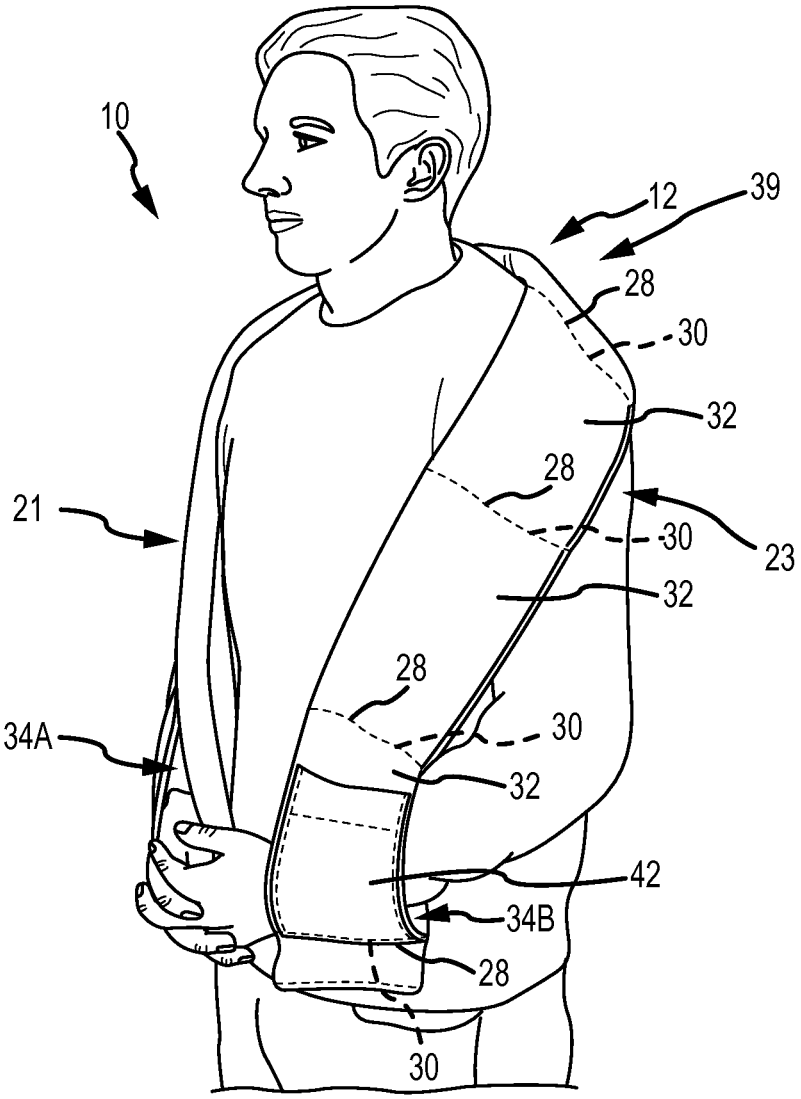
FIG. 9 is an isometric view of a support article such as those shown in FIGS. 1 through 3 being used by a wearer in a sixth example configuration.

FIG. 9 is another isometric view of a support article 10 such as those shown in FIGS. 1 through 3 (may though need not be identical to other implementations) being used by a wearer in a sixth example configuration. In this sixth configuration, the wrap support article 10 is draped over the shoulders but not as much the neck of a wearer. The longitudinal ends, first and second sides 20, 21, are disposed such that the wearer has extended his arms through a pair of opposing armrest-sleeve accesses 22 (22A/22B) at the same general level that correspond to a comfortable position. In this particular example, the wearer's hands and arms are extended through the bottom-most accesses disposed closest to the lateral edges of the support article 10. In this particular configuration, for example, the wearer is grasping his hands together and the support article 10 is supporting the weight of the wearer's arms and hands to provide a comfortable, supported position for the wearer. As in the other configurations, the support article 10, in this sixth configuration, provides stabilization support for the head, neck, shoulders, arms, hands, and back of the wearer. The support article 10 also provides warmth and possible soothing, therapeutic benefits.

Figure 10:
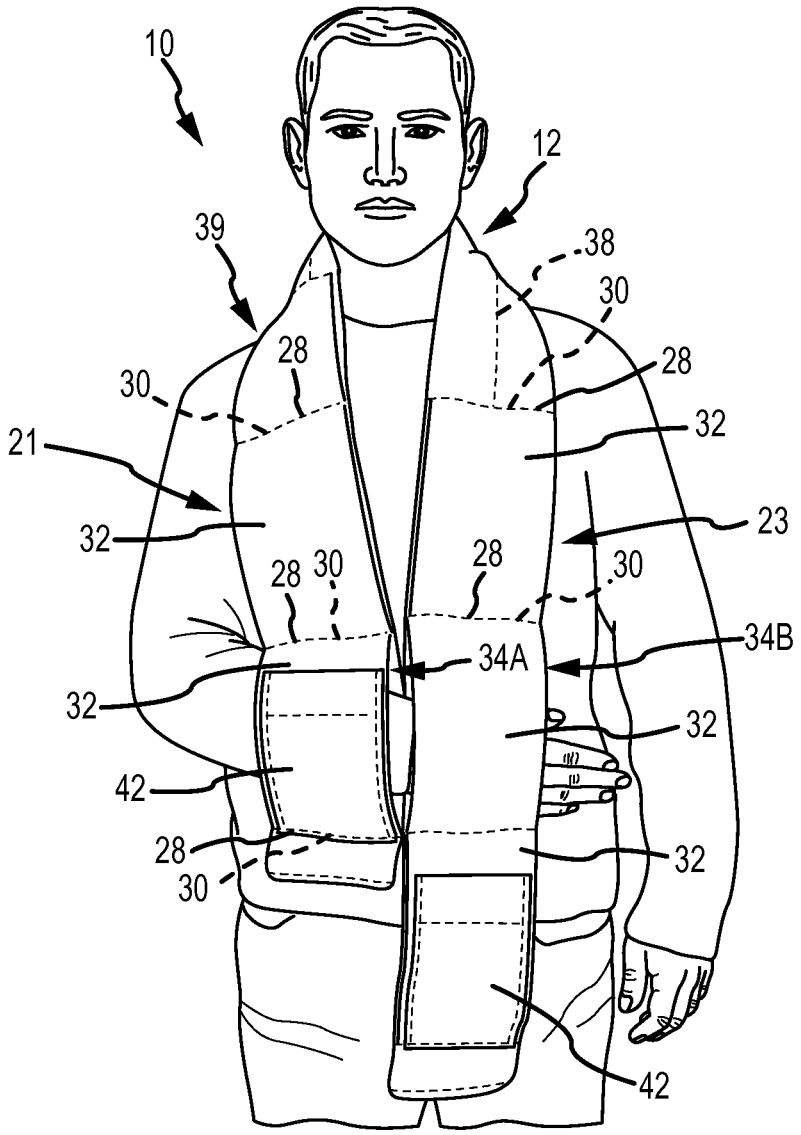
FIG. 10 is an isometric view of a support article such as those shown in FIGS. 1 through 3 being used by a wearer in a seventh example configuration.

FIG. 10 is still another isometric view of a support article 10 such as those shown in FIGS. 1 through 3 (may though need not be identical to other implementations) being used by a wearer in a seventh example configuration. In this seventh configuration, the support article 10 is again draped over the neck and shoulders of a wearer and the wearer has extended his right arm through a pair of opposing offset armrest-sleeve accesses 22 (22A/22B) adjusted to be at the same general level that correspond to a comfortable position and in which the therapeutic support article 10 provides a sling-like support for arm and/or shoulder of the wearer. In this particular configuration, for example, the wearer is extending his right arm through the lowest sleeve on side 20 and the middle sleeve on side 21 demonstrating the adjustability of the device as any combination of these sleeves may be used to achieve appropriate effect. Here, the effect is to dispose a single arm, here the right arm through the armrest-sleeve accesses 22 (22A/22B) on both sides of the support article 10 while the left arm is free to move. As in the other configurations, the support article 10, in this fifth configuration, provides stabilization support for the head, neck, and at least one shoulder, arm and/or hand, and back of the wearer.

Figure 11:
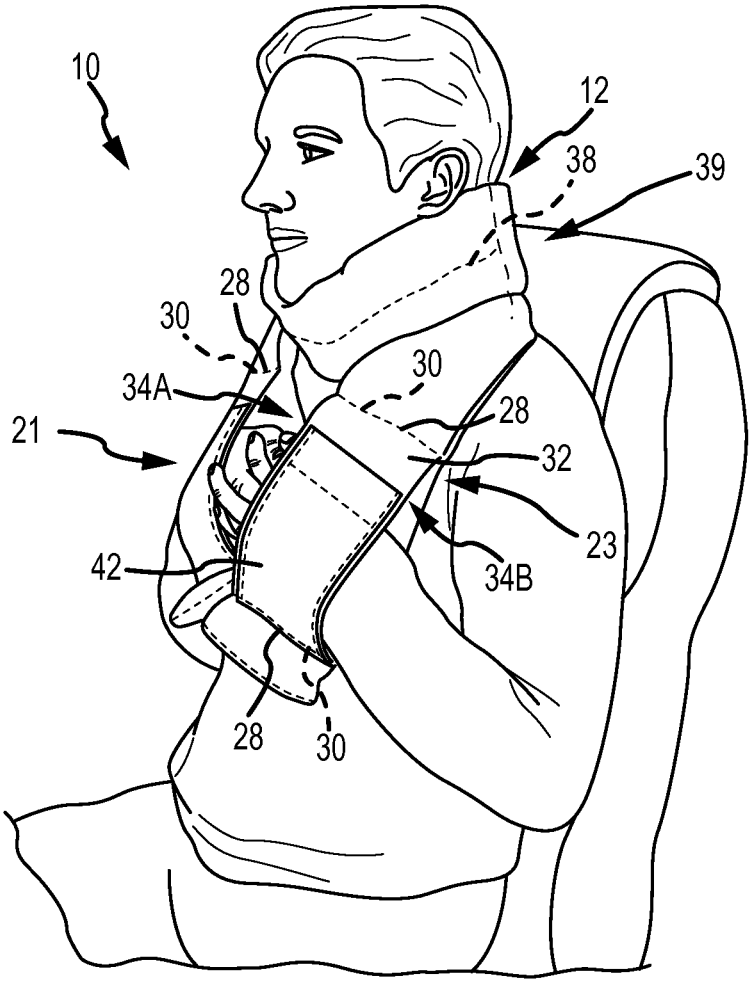
FIG. 11 is an isometric view of a support article such as those shown in FIGS. 1 through 3 being used by a wearer in a eighth example configuration.

FIG. 11 is an isometric view of a support article 10 such as those shown in FIGS. 1 through 3 (may though need not be identical to other implementations) being used by a wearer in an eighth example configuration. In this configuration, the support article 10 loops around the neck of the wearer one time. This looping shortens the longitudinal length of the support article 10 along the torso of the wearer In this eighth example configuration, the wearer extends his arms through the armrest sleeves 32 disposed at the longitudinal ends of the support article 10 such that the support article 10 supports the head, neck, shoulders, arms, hands, and back of the wearer, and further provides warmth for the wearer. Primarily, this disposition provides a great deal of stabilization for the head and neck which can offer therapeutic or rehabilitation effect.

FIG. 12 is an isometric view of a support article 10 such as those shown in FIGS. 1 through 3 (may though need not be identical to other implementations) being used by a wearer in a ninth example configuration. In this ninth configuration, the wearer has folded the support article 10 along the roll line 38 to reduce the lateral width of the support article 10 adjacent the neck of the wearer. The support article flexes along the roll line 38 to perhaps more comfortably conform to the wearer's neck. Such an implementation in use may be included with and/or be operable with respect to any or all of the alternative implementations described herein; as for particular examples those implementations shown in FIGS. 4-11, as well.

As shown in FIGS. 1, 2, and 4-12, pockets 42 are also shown as they would be operable for and/or accessible by the wearer for storing and accessing items such as a remote control, mobile phone, reading glasses, pen and notepad, snacks or the like. This/these alternative/s for inclusion of optional pockets 42 are also optionally available with any or all of the alternative implementations described herein; as for particular examples those implementations shown in FIGS. 4-11, as well. Similarly, a pocket 48, such as shown in FIG. 3, may also be disposed on the support article 10 as in any of those implementations of FIGS. 1, 2 and/or 4-12, such as along the neck region of the wearer, to receive a thermal or magnetic therapy pack 50 (e.g., a hot pack, cold pack, or therapeutic magnet) to provide thermal or magnetic therapy to the wearer. Such an implementation of a pocket 42 in use may be included with and/or be operable with respect to any or all of the alternative implementations described herein; as for particular examples those implementations shown in FIGS. 4-12, as well.

In many typical implementations, the entire length of the original support article is often padded or cushioned, however, in some implementations, only the neck section of the support article is padded or cushioned; such an implementation may sometimes alternatively be referred to as a theater support article, with no required limitation to such a use. All other features of such a so-called theater support article would or at least could typically be the same as those with the original support article. The reduction of padding or cushioning in the theater support article may render it somewhat less supportive and comforting than the original support article. However, the theater support article can be worn more discreetly in formal settings yet still provide a wearer significant support and comfort. Some fully functional implementations will have no padding or cushioning whatever, these being fully functional for support and comfort, inter alia.

Figure 13:
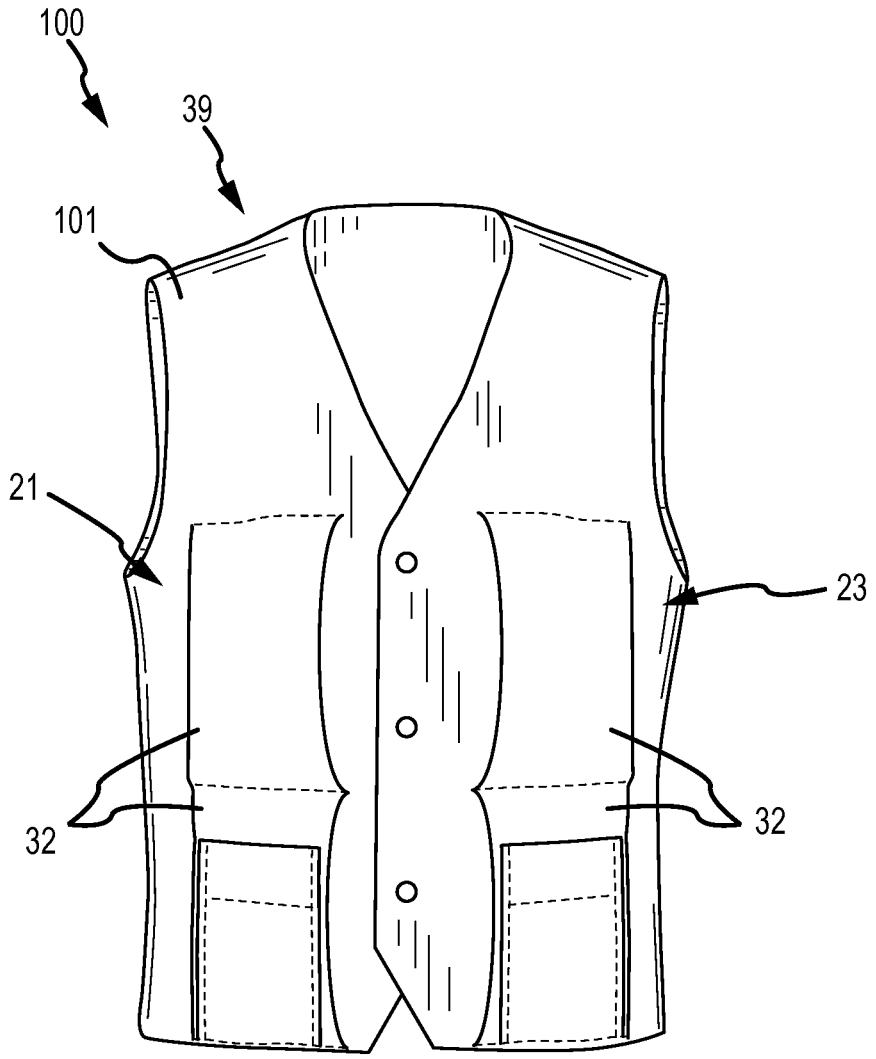
FIG. 13 is an isometric view of an alternative support article in a clothing adaption or configuration.

FIG. 13 is an isometric view of a further alternative implementation 100. The armrest-sleeve panels 23 which include the armrest-sleeve accesses 22 (22A/22B) that provide support and comfort in the original support article and the theater support article can also be applied (by means of sewing) to a relatively conventional garments 101. Such a garment could include coats, jackets, vests, shirts, or any articles of apparel that serve to clothe the torso. As in both the original support article and the theater support article, the armrest panels, when applied to upper-body apparel, are positioned on either side of a garment's vertical midline and afford a wearer support and comfort. The panels defining the armrest sleeves 32 (differentiated from and not to be confused with the garment's conventional sleeves) will preferably be proportionate to the clothing to which they are applied, e.g. an extra large man's jacket will have larger armrest accesses than a child's jacket. In some cases, it may be that only one armrest sleeve per side will be disposed thereon; however, it may be more typical that two armrest sleeves 32 per side might be included. Three armrest sleeves per side or any practical number may be included alternatively as well.

Figure 14:
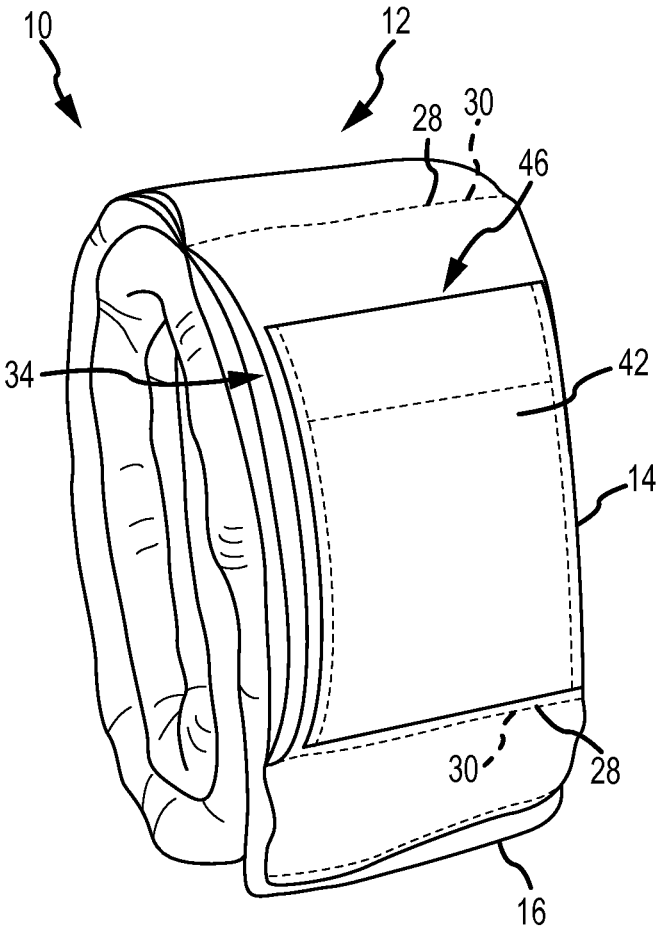
FIG. 14 is an isometric view of a support article, such as the support articles shown in FIGS. 1 through 12 disposed in a rolled up configuration for storage or carrying.

FIG. 14 is an isometric view of a support article such as that shown in FIGS. 1 through 3 disposed in a rolled or folded configuration serves as an effective lumbar support. This configuration demonstrates the support article's soft flexibility and that additionally, when rolled/folded, the support article is easily stored or carried and can be adapted to be disposed in a container, hard or soft (e.g., box or bag).

It may be noted that historically, slings of many configurations have been used to support the weight of a wearer's impaired arm or hand and reduce the weight of that arm on a wearer's neck, shoulder, and back as well as reducing gravity's pull on the injured member. What distinguishes the support article from many conventional slings is the ease with which it can be used, the comfort it affords, its range of adjustability, and its lack of often painfully binding configurations and closure apparatuses that typically hold slings in place. If treatment requires total, rigid immobilization of an extremity, the support article may not suffice. However, if the therapeutic goal is to gently stabilize a limb while allowing some degree of mobility, the support article may be an ideal therapeutic choice.

In addition, horseshoe pillows have been used to support a wearer's head when the wearer is sleeping in a seated position. While horseshoe pillows provide a free-floating area on which to rest one's head, horseshoe pillows do not provide stabilizing support for a wearer's head, neck, shoulders, arms, hands, and back or provide the wearer with comforting warmth and enfoldment.

Similarly, pressure vests have also been used to calm individuals who are sensorially challenged. Theoretically, a pressure vest calms a wearer by means of inserting weights into numerous pockets located on the vest. The purpose of these weights is to apply deep, uniform pressure on a wearer. Pressure vests extend around the torso of the wearer and include closure apparatuses to hold them in place. It may be noted that a support article as shown and described is discrete hereover. In contrast, a support article exerts a gentler, much less confining pressure on its wearer and affords its wearer greater control over the degree of pressure he or she experiences. A further distinguishing feature of the support article is its capacity for providing its wearer with a simple, gentle way to self-comfort.

There is longstanding and extensive evidence to support the theory that reducing stress has a wide range of beneficial effects on human health. Two world-renowned pioneers in the field of stress reduction, calming, and relaxation are Dr. Herbert Benson and Temple Grandin, PhD. Their widely respected work meets the highest scientific standards and demonstrates that one's ability to reduce stress and maintain relaxation is pivotal to physical, mental, and emotional health.

Dr. Herbert Benson is a graduate of Harvard Medical School, Professor of Medicine at Harvard Medical School, and founder of the Benson-Henry Institute at Massachusetts General Hospital in Boston. For more than forty years, Dr. Benson has been a leader in the field of mind/body medicine, studying the numerous ways stress impacts health and well-being, and developing treatments to alleviate it. These treatments are defined in Dr. Benson's best-selling book, The Relaxation Response. In studies at Harvard Medical School and its affiliated teaching hospitals, Dr. Benson has unarguably demonstrated the effectiveness of relaxation in alleviating the harmful consequences of stress and demonstrating that achieving relaxation, by any number of means, lowers high blood pressure, reduces chronic pain, and boosts immunity. Using the support article as described herein is one reliable way to achieve relaxation and to thereby enhance health and well-being.

Dr. Temple Grandin, is a world-renown animal behaviorist, international lecturer, and professor at Colorado State University. Diagnosed with autism at age four, Dr. Grandin, in her freshman year of college, invented the "squeeze-box" as a means of reducing her stress and relaxing herself. Eventually, Dr. Grandin discovered that the same squeezing-hugging-enclosing techniques she had found to be effective in calming herself were also effective in calming livestock. Today, Dr. Grandin's animal-calming systems are extensively implemented throughout the US and Europe. One prominent feature of Dr. Grandin's systems, the element of enclosure to create comfort, calming, and relaxation, particularly relates to the support article described herein and the parallel results this support article achieves by means of gentle enclosure.

Although various implementations of this disclosure have been describe above with a certain degree of particularity, those skilled in the art could make numerous alterations to the disclosed embodiments without departing from the spirit or scope of this disclosure. For example, although the implementation shown in FIGS. 1 through 9 show many possible features of a support article 10, such as but not limited to a plurality of armrest-sleeves for adjustability, pockets, batting, a pocket for thermal or magnetic therapy treatments, neck roll adjustability and the like, a support article may include any subset or combination of those features instead of necessarily including each of those features unless otherwise specified in the appended claims. All directional references (e.g., upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of the disclosure. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the disclosure as defined in the appended claims.

What is claimed is:

1. A limb support article for a user, the limb support article comprising:

an elongated structure having a longitudinal length, the elongated structure defining a longitudinally extending medial axis, the elongated structure having:

a central section and first and second frontal depending sections connected to the central section and extending from the central section; the first and second frontal depending sections depending from the central section draped in use about a body of the user; the elongated structure being configured as an elongated rectangle when opened not in use;

at least one storage pocket disposed in at least one of the first and second depending sections of the elongated structure; and a plurality of sleeves, each sleeve of the plurality of sleeves having two lateral opposing openings for the user to extend one or more of the user's limb, hand, wrist, forearm or arm laterally through both of the lateral opposing openings from either direction, each of the first and second frontal depending sections having more than one sleeve of the plurality of sleeves; the sleeves being arranged adjacent to each other disposed at different longitudinal distances along the longitudinal length of the elongated structure; the plurality of sleeves providing adjustability in an operative length and options for alternative use of any combination of the plurality of sleeves with each other; the adjustability and the operative length being provided and defined by an optional selection of discrete sleeves as disposed at different longitudinal distances along the longitudinal length that thereby provide discretely disparate operative lengths in use depending on which one or more of the plurality of sleeves the user selects;

the elongated structure having, when in an open disposition with no parts of the central section folded upon other parts of the central section:

a pair of longitudinal edges extending along the longitudinal length and a pair of short lateral edges extending across a lateral width;

the central section and first and second frontal depending sections of the elongated structure being defined by the pair of longitudinal edges, the first and second frontal depending sections being further defined by the pair of relatively-shorter lateral edges at respective ends of the elongated structure;

the plurality of sleeves being defined by one or more layers of rectangular panels to one or both of the first and second frontal depending sections;

the one or more layers of rectangular panels being attached respectively to the first and second frontal depending sections along a plurality of lateral attachment lines and each sleeve of the plurality of sleeves is disposed between two of the plurality of lateral attachment lines;

the plurality of lateral attachment lines being formed by one or more of: stitching, adhesive, bonding, staking, heat staking, hooks, hook and loop fasteners, clips, rivets, snaps and buttons;

the elongated structure being configured to be worn about one or more of a neck of the user, a shoulder or both shoulders or a back of the user; and, each of the plurality of sleeves being configured to have one or more of the user's limb, hand, wrist, forearm or arm disposed in one or more of the plurality of sleeves to provide comfortable support to the user.

2. A system for supporting one or more of a wearer's head, neck, shoulders, arms, hands, or back comprising:

a device to be worn by the wearer, the device being an elongated support article having a longitudinal length, the support article having:

a central section and a first front depending side, depending from the central section and a second front depending side, depending from the central section, the first and second front depending sides being in a front of a body of the wearer when in use, and, at least one storage pocket disposed in at least one of the first and second depending sections of the elongated structure, and, each of the first and second front depending sides having a plurality of armrest sleeves formed upon or therewithin each of the first and second front depending sides, the plurality of armrest sleeves being for use on the front of the body of the wearer; each sleeve of the plurality of armrest sleeves having two lateral opposing openings for the wearer to extend one or more of the wearer's hand, wrist, forearm or arm laterally through the armrest sleeve openings from either direction, the sleeves being arranged adjacent to each other disposed at different longitudinal distances along the longitudinal length of the elongated support article; the plurality of armrest sleeves providing adjustability in an operative length and options for alternative use of any combination of the plurality of armrest sleeves with each other; the adjustability being provided by selection of discrete sleeves of the plurality of armrest sleeves as disposed at different longitudinal distances along the longitudinal length that thereby provide discretely disparate operative lengths in use depending on which of the discrete sleeves of the plurality of armrest sleeves the wearer selects;

the elongated support article further comprising:

a central pocket in the central section configured to receive at least one therapeutic support pillow, hot/cold thermal pack or magnet;

the central pocket in the central section being one or both of:

disposed along a medial axis of the support article; and, disposed configured for engagement with the wearer's neck or one or more shoulders when in use.

3. A system according to claim 2, wherein the device is a garment.

* * * * *